US007288880B2

(12) United States Patent
Ito

(10) Patent No.: US 7,288,880 B2
(45) Date of Patent: Oct. 30, 2007

(54) HIGH-LUMINANCE GAS DISCHARGE TUBE WITH DIAPHRAGM ELEMENTS WITHIN DISCHARGE PATH

(75) Inventor: Yoshinobu Ito, Hamamatsu (JP)

(73) Assignee: Hamatsu Photonics K.K., Shizuoka (JP)

( * ) Notice: Subject to any disclaimer, the term of this patent is extended or adjusted under 35 U.S.C. 154(b) by 138 days.

(21) Appl. No.: 10/491,110

(22) PCT Filed: Sep. 27, 2002

(86) PCT No.: PCT/JP02/10093

§ 371 (c)(1),
(2), (4) Date: Oct. 7, 2004

(87) PCT Pub. No.: WO03/030208

PCT Pub. Date: Apr. 10, 2003

(65) Prior Publication Data

US 2005/0046320 A1 Mar. 3, 2005

(30) Foreign Application Priority Data

Sep. 28, 2001 (JP) ..... 2001-301277

(51) Int. Cl.
*H01J 17/02* (2006.01)
*H01J 17/04* (2006.01)

(52) U.S. Cl. ..... 313/231.31; 313/609; 313/610; 313/611; 313/612; 313/231.01; 313/631; 313/632

(58) Field of Classification Search ..... 313/231.31, 313/595–633, 1, 231.01
See application file for complete search history.

(56) References Cited

U.S. PATENT DOCUMENTS 5,191,260 A * 3/1993 Kawai et al. ..... 313/613
5,552,669 A 9/1996 Ikedo et al. ..... 313/613
5,587,625 A 12/1996 Ikedo et al. ..... 313/613
5,619,101 A 4/1997 Ikedo et al. ..... 313/581
5,633,563 A 5/1997 Ikedo et al. ..... 313/614
5,646,487 A 7/1997 Ikedo et al. ..... 313/613

(Continued)

FOREIGN PATENT DOCUMENTS

JP 6-310101 11/1994

(Continued)

*Primary Examiner*—Sikha Roy
*Assistant Examiner*—Natalie K. Walford
(74) *Attorney, Agent, or Firm*—Drinker Biddle & Reath LLP

(57) ABSTRACT

In a gas discharge tube, a first discharge path-induction portion is arranged between a first discharge path-limit portion and a second discharge path-limit portion. A voltage is applied to the first discharge path-induction portion from the outside. As a result, an active starting discharge capable of passing through a first opening of the first discharge path-limit portion is produced between a cathode portion and the first discharge path-induction portion. As a consequence, there is facilitated the discharge at a starting time to pass through a second opening. As a consequence, there is achieved a rapid starting of discharge between the cathode portion and an anode portion. Therefore, in order to achieve further enhancement of brightness, there can be carried out with ease a further miniaturization pertaining to the openings, in terms of its area size, of the discharge path-limit portion while the starting properties being kept excellent, without any increase in a voltage at the starting time of the lamp so much.

16 Claims, 14 Drawing Sheets

U.S. PATENT DOCUMENTS

| | | | | |
|---|---|---|---|---|
| 5,684,363 | A | 11/1997 | Ikedo et al. | 313/613 |
| 5,698,945 | A | 12/1997 | Ikedo et al. | 313/613 |
| 5,886,470 | A * | 3/1999 | Smolka | 313/637 |
| 6,531,821 | B1 * | 3/2003 | Ikedo et al. | 313/613 |
| 6,559,576 | B1 * | 5/2003 | Ikedo et al. | 313/25 |
| 6,573,655 | B1 * | 6/2003 | Ikedo et al. | 313/623 |
| 6,637,913 | B2 * | 10/2003 | Sei et al. | 362/373 |
| 6,870,317 | B2 * | 3/2005 | Ito et al. | 313/631 |
| 6,873,107 | B2 * | 3/2005 | Kawai et al. | 313/623 |
| 6,956,326 | B2 * | 10/2005 | Kawai et al. | 313/609 |

FOREIGN PATENT DOCUMENTS

| | | |
|---|---|---|
| JP | 10-064479 | 3/1998 |

* cited by examiner

HIGH-LUMINANCE GAS DISCHARGE TUBE WITH DIAPHRAGM ELEMENTS WITHIN DISCHARGE PATH

TECHNICAL FIELD

The present invention relates to a gas discharge tube, and in particular to a gas discharge tube used as a light source for a spectroscope, a chromatography or the like.

BACKGROUND ART

There is disclosed as a prior art pertaining to the related technical field a gas (deuterium) discharge tube in Japanese Patent Laid-Open No.6-310101 publication. In a gas (deuterium) discharge tube described in this publication, there are arranged two metal partition walls within the discharge path between an anode and a cathode, wherein each of the metal partition walls is provided with small holes, whereby the discharge path is caused to be narrowed. As a result, it is made possible to obtain light with a high luminance by means of the small holes on the discharge path. Further, provision of three or more metal partition walls could lead to a further higher luminance. The smaller holes are made, the higher luminance of light there can be obtained.

DISCLOSURE OF THE INVENTION

On considering the above-described conventional art, the present inventor has found the following problems to be solved. That is, although in the above-described conventional gas discharge tube, the small holes of each metal partition wall could be used for narrowing the discharge path, so as to enhance luminance, there must be increased a discharge starting voltage to the greater extent, as the small holes are made smaller, as also described in this publication, with the result that there is a marked restriction on the diameter of the small holes or the number of metal partition walls.

The present invention has been made in order to solve the above-described problem, and an object thereof is to provide a gas discharge tube excellent in starting properties while achieving enhancement of luminance.

A gas discharge tube according to the present invention emits a predetermined light from a light emitting window of a sealed container with a charged gas toward the outside by producing a discharge between a cathode portion and an anode portion enclosed in the container. The tube comprises: a first discharge path-limit portion, arranged in a midway of a discharge path between the anode portion and the cathode portion, and provided with a first opening for narrowing the discharge path; a second discharge path-limit portion, arranged in a midway of the discharge path between the first discharge path-limit portion and the anode portion, and provided with a second opening for narrowing the discharge path; and a first discharge path-induction portion, arranged between the first discharge path-limit portion and the second discharge path-limit portion, and electrically connected to an external power source.

In the gas discharge tube, in case where light with high luminance is to be created, it is insufficient to simply make an opening portion for narrowing the discharge path smaller. The smaller the opening portion is made, the greater difficulty arises in causing discharge at a time of lamp starting. Therefore, in order to improve starting properties of a lamp, there is need to generate a remarkably large potential difference between the cathode portion and the anode portion.

As a result, it has been confirmed in an experiment that the service life of the lamp is shortened. In view of the foregoing, in a gas discharge tube of the present invention, a first discharge path-induction portion is arranged between a first discharge path-limit portion and a second discharge path-limit portion. A voltage is applied to the first discharge path-induction portion from the outside in order to improve the starting properties of the lamp even if the discharge path has been narrowed. As a result, a starting discharge capable of passing through a first opening of the first discharge path-limit portion is produced between a cathode portion and the first discharge path-induction portion. As a consequence, it is facilitated for the discharge at a starting time to pass through a second opening. As a consequence, there is achieved a rapid starting of discharge between the cathode portion and an anode portion. Therefore, in order to accomplish further enhancement of brightness, there can be carried out with ease a further miniaturization pertaining to the opening, in terms of its area size, of the discharge path-limit portion while the starting properties being kept excellent, without any increase in a voltage at the starting time of the lamp so much.

Further, it is preferable that the first discharge path-limit portion and the second discharge path-limit portion are electrically insulated from each other. By adopting such a constitution, the first discharge path-limit portion and the second discharge path-limit portion can be set to different potentials, so that the starting properties of the lamp can be improved.

Furthermore, it is preferable that a distal end portion of the first discharge path-induction portion is conical. By adopting such a constitution, the density of charged particles can be made higher at a distal end of the first discharge path-induction portion so that the starting properties of the lamp is made further better.

Furthermore, it is preferable that the first and second openings of the first and second discharge path-limit portions are formed at bottom portions of cup portions spread towards the light-emitting window. By adopting such a constitution, arc balls are securely created at the cup portions of the first and second discharge path-limit portions so that a further enhancement of luminance can be achieved by creation of the two arc balls.

Moreover, it is preferable that the gas discharge tube further comprises a third discharge path-limit portion, arranged in a midway of the discharge path between the second discharge path-limit portion and the anode portion, and provided with a third opening for narrowing the discharge path. This serves to produce light with high luminance to a certain extent.

Further, it is preferable that the second discharge path-limit portion and the third discharge path-limit portion are electrically insulated from each other. The second discharge path-limit portion and the third discharge path-limit portion can be set to different potentials so that the starting properties of the lamp can be improved even in case of using three discharge path-limit portions.

In addition, it is preferable that the third opening of the third discharge path-limit portion is formed at a bottom portion of a cup portion spread towards the light emitting widow. When such a constitution is employed, an arc ball is securely produced at the cap portion of the third discharge path-limit portion so that a further enhancement of luminance can be achieved.

Furthermore, it is preferable that the gas discharge tube comprises a second discharge path-induction portion, arranged between the second discharge path-limit portion and the third discharge path-limit portion, and electrically connected to an external power source. By employing the second discharge path-induction portion, the starting properties of the lamp when utilizing three discharge path-limit portions are further improved.

Further, it is preferable that a distal end portion of the second discharge path-induction portion is conical. When such a constitution is employed, a density of charged particles can be made higher at the distal end of the second discharge path-induction portion, so that the starting properties of the lamp is further made better.

Furthermore, it is preferable that the second discharge path-induction portion is applied to a voltage higher than that applied to the first discharge path-induction portion. Thereby, the starting discharge can be generated smoothly.

A gas discharge tube according to the present invention emits a predetermined light from a light emitting window of a sealed container with a charged gas toward the outside by producing a discharge between a cathode portion and an anode portion enclosed in the container. The tube comprising: a first discharge path-limit portion, arranged in a midway of a discharge path between the anode portion and the cathode portion, and provided with a first opening for narrowing the discharge path; and a second discharge path-limit portion, arranged in a midway of the discharge path between the first discharge path-limit portion and the anode portion, and provided with a second opening for narrowing the discharge path. The first discharge path-limit portion and the second discharge path-limit portion being electrically insulated from each other.

In the gas discharge tube, the first discharge path-limit portion and the second discharge path-limit portion are electrically insulated from each other in order to make a starting properties of a lamp excellent even if the discharge path is narrowed. Thereby, the first discharge path-limit portion and the second discharge path-limit portion can be set to different potentials. Therefore, by adjusting each potential, discharge at a starting time is facilitated to pass through the inside of the second opening. As a result, discharge between the cathode portion and the anode portion is started rapidly. Therefore, in order to achieve a further enhancement of luminance, there can be accomplished with ease a further miniaturization, of the opening, in terms of its area size, in the discharge path-limit portion while the starting properties being kept excellent without any increase in the voltage at the time of lamp starting so much.

Further, it is preferable that the second discharge path-limit portion is shielded from the cathode portion by an insulating material. With such a constitution, there is prevented occurrence of an abnormal discharge due to bending around-discharge extending from the cathode portion toward the second discharge path-limit portion.

Furthermore, it is preferable that an annular spacer of insulating material for positioning the second discharge path-limit portion and the anode portion is provided between the second discharge path-limit portion and the anode portion. With such a constitution, improvement in positioning accuracy between the second discharge path-limit portion and the anode portion can be achieved.

Moreover, it is preferable that the gas discharge tube further comprises a third discharge path-limit portion, arranged in a midway of the discharge path between the second discharge path-limit portion and the anode portion, and provided with a third opening for narrowing the discharge path. The first, second and third discharge path-limit portions are electrically insulated from one another, respectively. By providing the third discharge path-limit portion in this manner, further high luminance is achieved. At this time, since the first, second and third discharge path-limit portions are electrically insulated from one another respectively, the first, second and third discharge path-limit portions can be set to different potentials, respectively. Accordingly, by adjusting each potential, discharge at a starting time is facilitated so as to pass through the insides of the second opening. As a result, discharge between the cathode portion and the anode portion is to be started rapidly, so that the starting properties of the lamp can be improved even in case of using three discharge path-limit portions.

In addition, it is preferable that the second and third discharge path-limit portions are shielded from the cathode portion by insulating material. With such a constitution, occurrence of an abnormal discharge due to bending around-discharge extending from the cathode portion toward the second and third discharge path-limit portions is prevented.

Further, it is preferable that an annular spacer of insulating material for positioning the third discharge path-limit portion and the anode portion is provided between the third discharge path-limit portion and the anode portion. With such a constitution, improvement in positioning accuracy between the third discharge path-limit portion and the anode portion can be achieved.

The present invention is made further sufficiently understandable according to the following detailed description and the attached drawings. These are merely shown for exemplification, and it should not be thought that they limit the present invention.

BEST MODE FOR CARRYING OUT THE INVENTION

Preferred embodiments of a gas discharge tube according to the present invention will be explained in detail below with reference to the drawings.

FIRST EMBODIMENT

Figure 1:
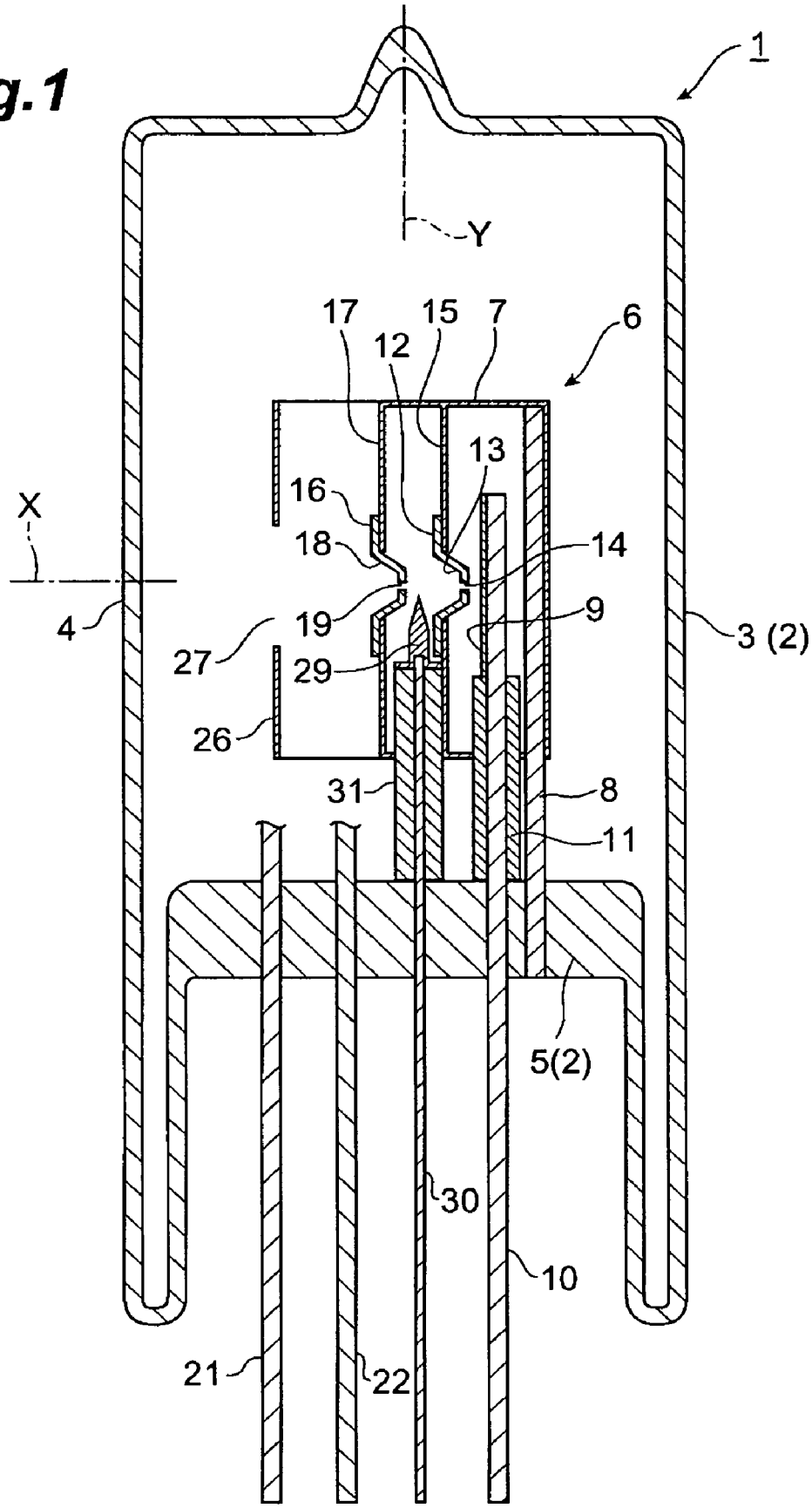
FIG. 1 is a sectional view showing a first embodiment of a gas discharge tube according to the present invention.
Figure 2:
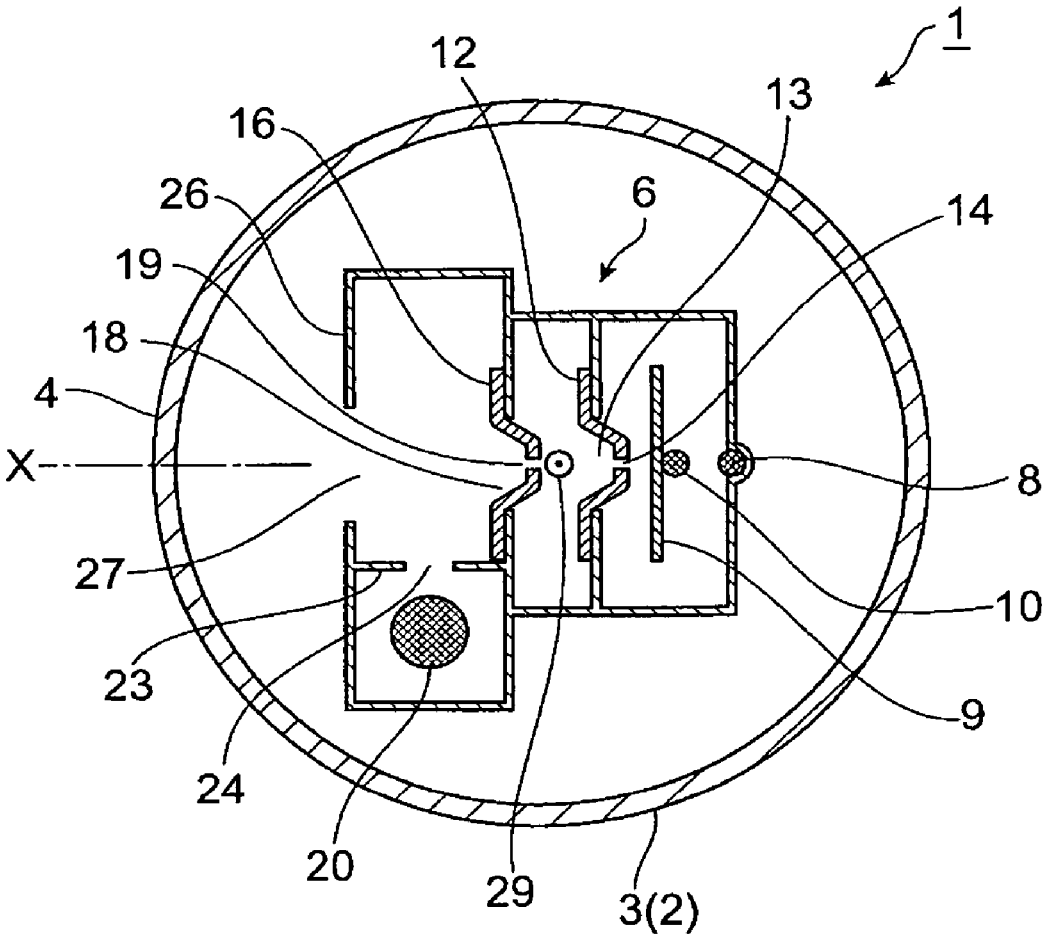
FIG. 2 is a transverse sectional view of the gas discharge tube shown in FIG. 1.

As shown in FIG. 1 and FIG. 2, a gas discharge tube 1 is a deuterium lamp of a side-on type, and the discharge tube 1 has a sealed container 2 made of glass in which deuterium gas is enclosed in an amount of about several hundreds Pa. This sealed container 2 comprises a cylindrical side tube 3 whose one end side is sealed and a stem 5 for sealing the other end side of the side tube 3, and one portion of the side tube 3 is utilized as a light emitting window 4. Then, a light emitting assembly 6 is accommodated inside the sealed container 2.

The light emitting assembly 6 has an electrically conductive casing 7 made of metal such as nickel or the like, and the casing 7 is welded and fixed to a distal end of a stem pin 8 which is provided on the stem 5 upstanding so as to extend in Y direction of a tube axis. Further, a plate-like anode portion 9 is accommodated inside the light emitting assembly 6, and the anode portion 9 is welded and fixed to a distal end portion of a stem pin 10 which is provided on the stem 5 upstanding so as to extend in the Y direction of the tube axis. Then, the stem pin 10 is accommodated in a pipe 11 made of alumina or the like in order to maintain an electrically insulating property inside the sealed container 2.

Further, a second discharge path-limit portion 12 facing the anode portion 9 is accommodated inside the casing 7, and the second discharge path-limit portion 12 is welded and fixed to the casing 7 via an electrically conductive metal-made supporting plate 15. The second discharge path-limit portion 12 is made of electrically conductive metal (for example, molybdenum, tungsten, or alloy made of these material) and has a cup portion 13 for forming an arc ball, and this cup portion 13 is spread toward the light emitting window 4 so as to receive an arc ball produced by discharge to take out light with high luminance efficiently. Further, a second opening 14 for narrowing a discharge path is provided at a bottom portion of the cup portion 13, and the second opening 14 comprises, for example, a small hole with a diameter of about 0.5 to 1 mm.

Furthermore, a first discharge path-limit portion 16 facing the second discharge path-limit portion 12 is fixed to the casing 17, and the first discharge path-limit portion 16 is welded and fixed to the casing 7 via an electrically conductive metal-made supporting plate 17. The first discharge path-limit portion 16 is made of electrically conductive metal (for example, molybdenum, tungsten, or alloy made of these material) and has a cup portion 18 for forming an arc ball, and this cup portion 18 is spread toward the light emitting window 4 so as to receive an arc ball produced by discharge to take out light with high luminance efficiently. Further, a first opening 19 for narrowing the discharge path is provided at a bottom portion of the cup portion 18, and the first opening 19 comprises a small hole with a diameter equal to or more than that of the second opening 14 (for example, about 0.5 to 1 mm). Then, the first opening 19 and the second opening 14 are aligned on an optical axis line X.

In the light emitting assembly 6, also, a cathode portion 20 is arranged at a position deviated from an optical path, and the cathode portion 20 has a coil portion made of tungsten for generating thermions (refer to FIG. 2). Then, one end of the cathode portion 20 is welded and electrically connected to a stem pin 21 provided upstanding on the stem 5, and the other end of the cathode portion 20 is welded and electrically connected to a stem pin 22 provided upstanding on the stem 5.

Furthermore, a discharge rectifying plate 23 is provided at a position deviated from the optical path between the cathode portion 20 and the first discharge path-limit portion 16. An electron emission opening 24 for allowing passing through of thermions is formed at the discharge rectifying plate 23. Further, an electrically conductive front cover 26 made of metal such as nickel or the like is fixed to the casing 7, and a light passage opening 27 aligned to the first opening 19 and the second opening 14 on the optical axis line X is provided at the front cover 26. By accommodating the cathode portion 20 inside the front cover 26 in this manner, sputtered substance or evaporated substance generated from the cathode portion 20 is prevented from adhering to the light emitting window 4.

Here, in case where light with a high luminance is to be created, it is insufficient to simply make the openings 14 and 19 for narrowing a discharge path smaller. The smaller the opening portion is made, the greater difficulty there arises in causing discharge at a time of lamp starting. Therefore, in order to improve starting properties of a lamp, there is need to generate a remarkably large potential difference between the cathode portion 20 and the anode portion 9. As a result, it has been confirmed in an experiment the service life of the lamp becomes short.

Therefore, a first discharge path-induction portion 29 is arranged between the first discharge path-limit portion 16 and the second discharge path-limit portion 12 inside the casing 7. The discharge path-induction portion 29 is welded and fixed to a distal end portion of a stem pin 30, which is provided upstanding on the stem 5 to extend in the Y direction of the tube axis. Then, the stem pin 30 is accommodated in a pipe 31 made of alumina or the like in order to maintain an electrically insulating property inside the sealed container 2 and can be supplied with a predetermined voltage from the outside.

Further, a distal end portion of the discharge path-induction portion 29 is conical, and its tip end is provided at a position slightly deviated from a line connecting the first opening 19 and the second opening 14 so as not to block discharging. When the distal end of the discharge path-induction portion 29 is sharpened in this manner, a density of charged particles can be enhanced at a tip end of the first discharge path-induction portion 29 so that the starting properties of the lamp can be made better.

By adopting such a discharge path-induction portion 29 as described above, there can be produced between the cathode portion 20 and the first opening 19 an active starting discharge making it possible to pass through the first opening 19 of the first discharge path-limit portion 16. For this reason, discharge at a starting time is facilitated to pass within the second opening 14. As a result, discharge between the cathode portion 20 and the anode portion 9 is started rapidly. Therefore, in order to achieve further enhancement of brightness, there can be accomplished with ease a further miniaturization of the openings 14 and 19, in terms of its area size, in the discharge path-limit portions, while the starting properties being kept excellent without any increase in the voltage at the time of lamp starting so much.

Next, an operation of the deuterium gas discharge tube 1 described above will be explained.

First, power of 10W or so is supplied from the external power source to the cathode portion 20 via the stem pins 21 and 22 for about 20 seconds before discharging, so that a coil portion of the cathode portion 20 is preheated. Thereafter, a voltage of about 160V is applied across the cathode portion 20 and the anode portion 9 from an external power source so that preparation for arc discharge is completed.

After the preparation has been completed, a trigger voltage of about 350V is applied from the external power source to the discharge path-induction section 29 via the stem pin 30. Thereby, discharge between the cathode portion 20 and the discharge path-induction portion 29 is generated, which serves as a trigger so that discharge is generated between the cathode portion 20 and the anode portion 9. Then, once such a starting discharge occurs, arc discharge is maintained between the cathode portion 20 and the anode portion 9, and arc balls are generated near the respective first and second openings 19 and 14, which have narrowed the discharge path. Then, ultraviolet rays taken out from two arc balls pass through the light emitting window 4 to be emitted to the outside as light with an extremely high luminance.

SECOND EMBODIMENT

Figure 3:
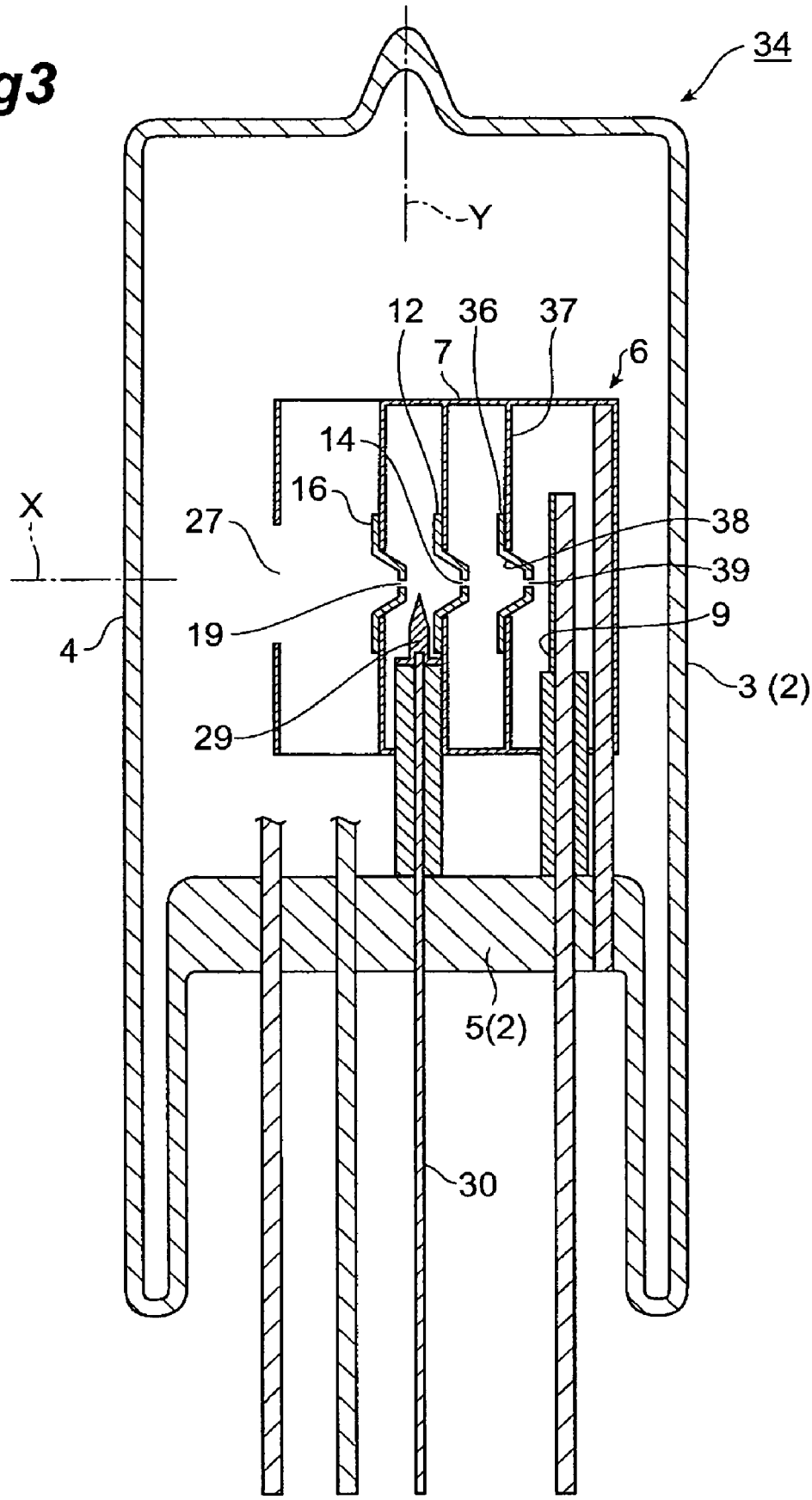
FIG. 3 is a sectional view showing a second embodiment of a gas discharge tube according to the present invention.
Figure 4:
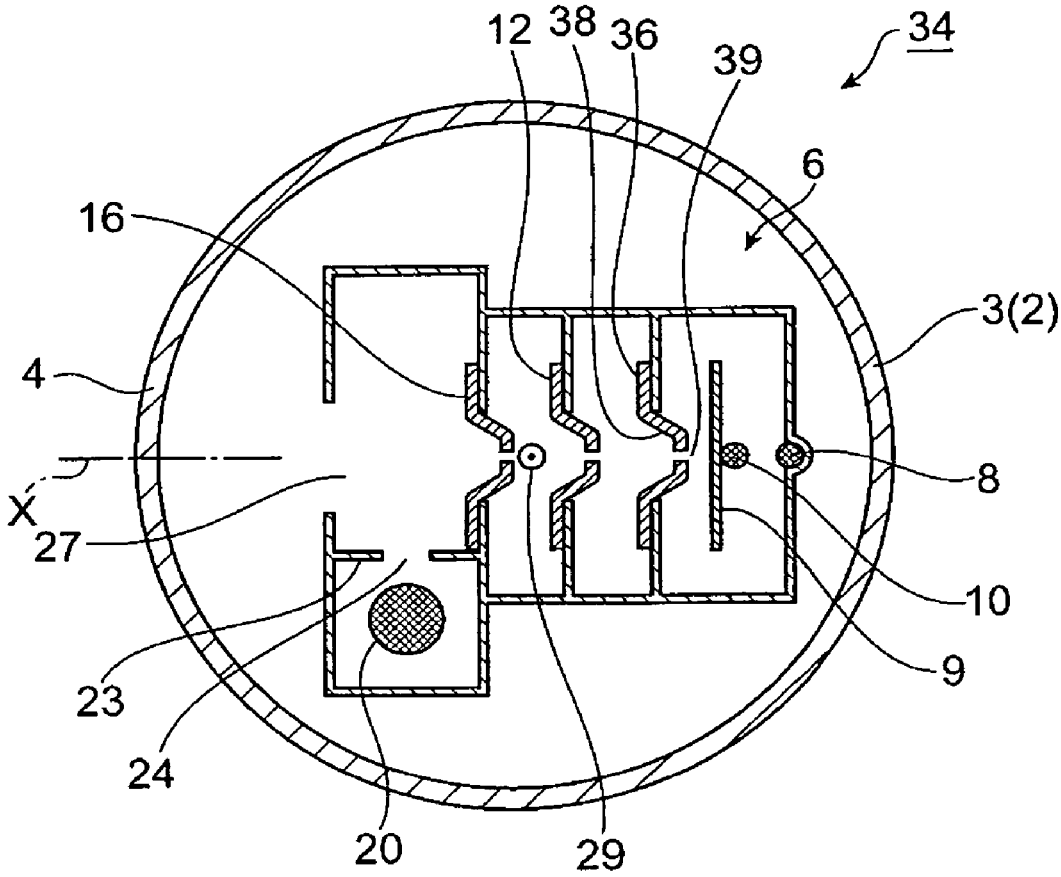
FIG. 4 is a transverse sectional view of the gas discharge tube shown in FIG. 3.

As shown in FIG. 3 and FIG. 4, a gas discharge tube 34 is a deuterium lamp of a side-on type. The gas discharge tube 34 is different from the first embodiment in that three discharge path-limit portions are provided, and identical or similar constitution elements therein are designated with same reference numerals and explanation thereof will be omitted.

A third discharge path-limit portion 36 is accommodated between the second discharge path-limit portion 12 and the anode portion 9 in the casing 7 of the gas discharge tube 34, and the third discharge path-limit portion 36 is welded and fixed to the casing 7 via an electrically conductive supporting plate 37 made of metal. The third discharge path-limit portion 36 is made of electrically conductive metal (for example, molybdenum, tungsten, or alloy made of these materials) and has a cup portion 38 for forming an arc ball, and this cup portion 38 is spread toward the light emitting window 4 so as to receive an arc ball produced by discharge to take out light efficiently.

Further, a third opening 39 for narrowing a discharge path is provided at a bottom portion of the cup portion 38, and the third opening 39 comprises a small hole with a diameter equal to or less than that of the second opening 14 (for example, about 0.5 to 1 mm). Then, the first opening 19, the second opening 14 and the third opening 39 are aligned on an optical axis line X. By utilizing the three discharge path-limit portions 12, 16 and 36 aligned in this manner, proper arc balls can be produced at the respective cup portions 13, 18 and 38, so that further increase in luminance can be achieved.

THIRD EMBODIMENT

Figure 5:
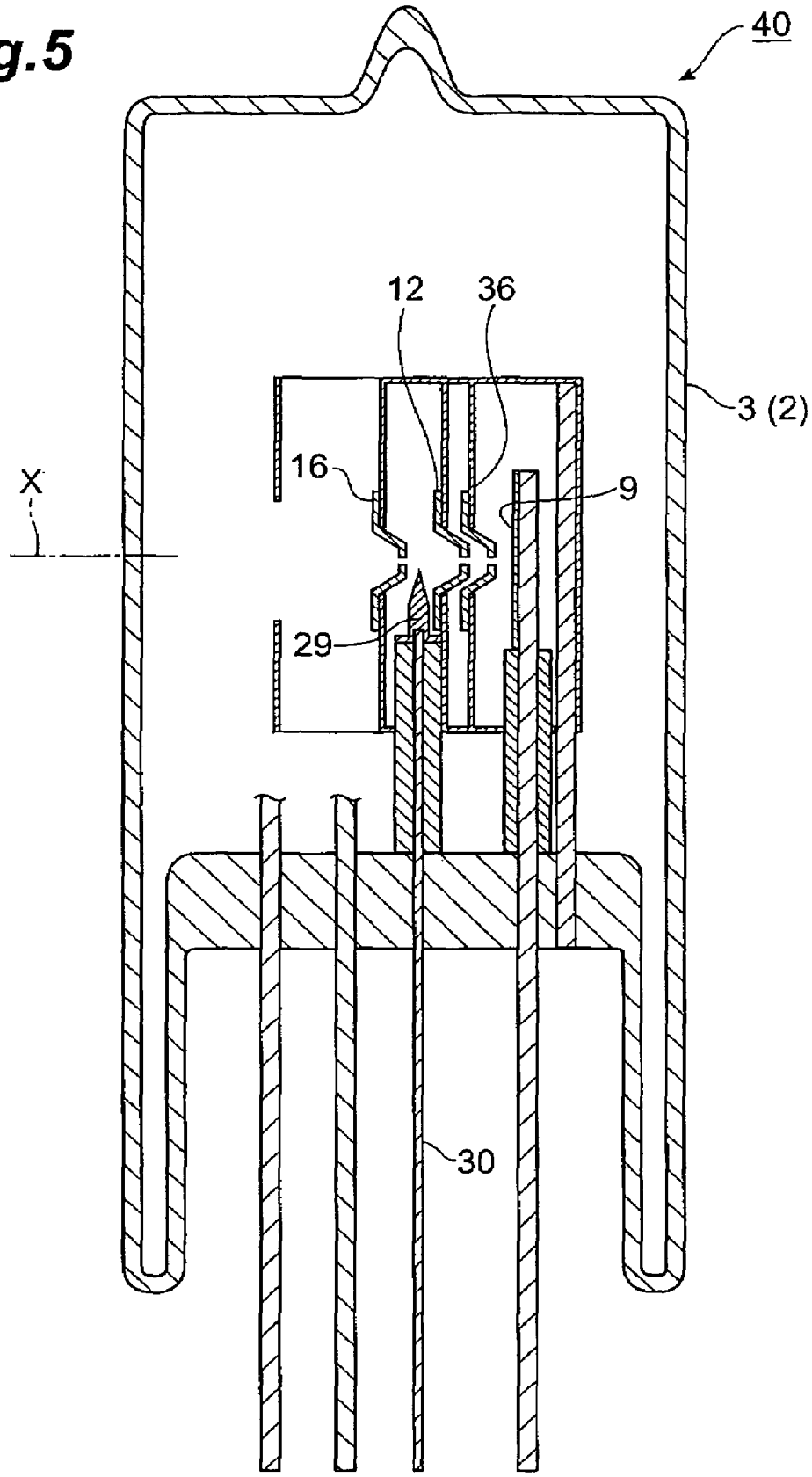
FIG. 5 is a sectional view showing a third embodiment of a gas discharge tube according to the present invention.
Figure 6:
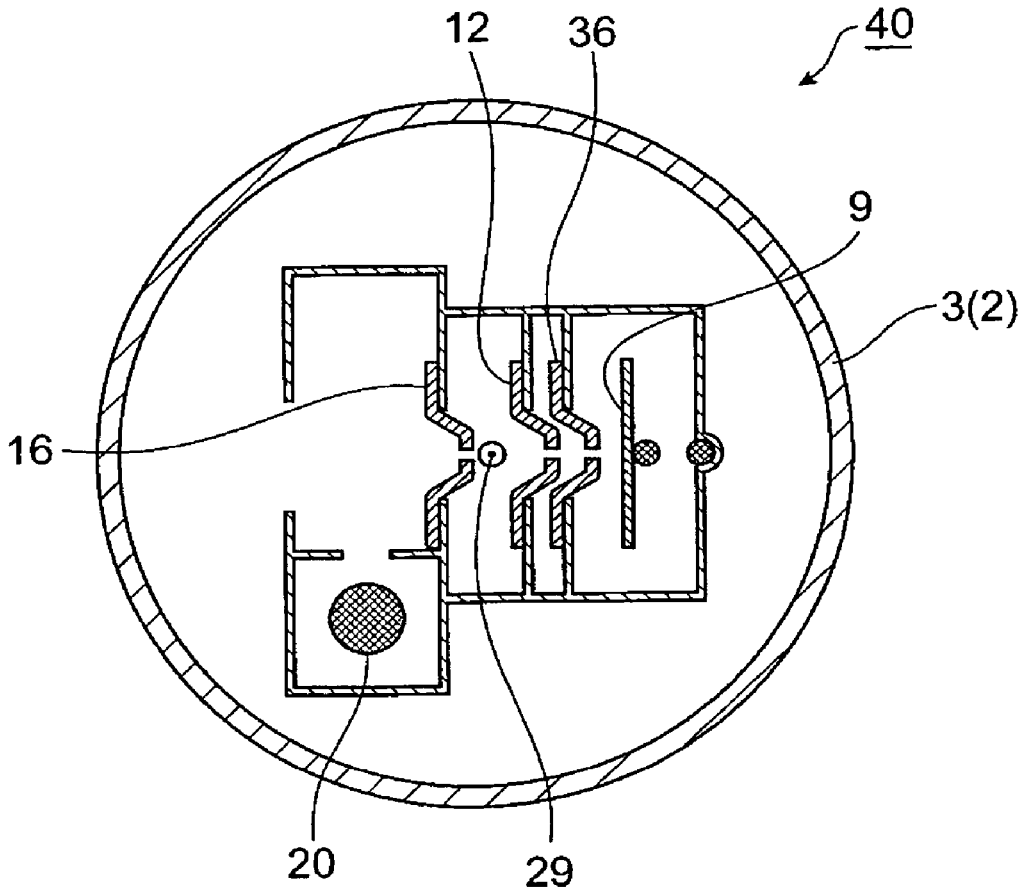
FIG. 6 is a transverse sectional view of the gas discharge tube shown in FIG. 5.

As shown in FIG. 5 and FIG. 6, a gas discharge tube 40 is a deuterium lamp of a side-on type, and the gas discharge tube 40 is identical to the second embodiment in that the three discharge path-limit portions 12, 16 and 36 are provided, while there is a difference in such an arrangement that the second discharge path-limit portion 12 and the third discharge path-limit portion 36 come closer to each other. As a result of such an arrangement that the second discharge path-limit portion 12 and the third discharge path-limit portion 36 come closer to each other at a distance of, for example, 0.1 mm to 1 mm there between in this manner, spreading of discharge can be suppressed at a location of the discharge path positioned between the second opening 14 and the third opening 39, so that the starting properties can be made better and luminance can be enhanced.

FOURTH EMBODIMENT

Figure 7:
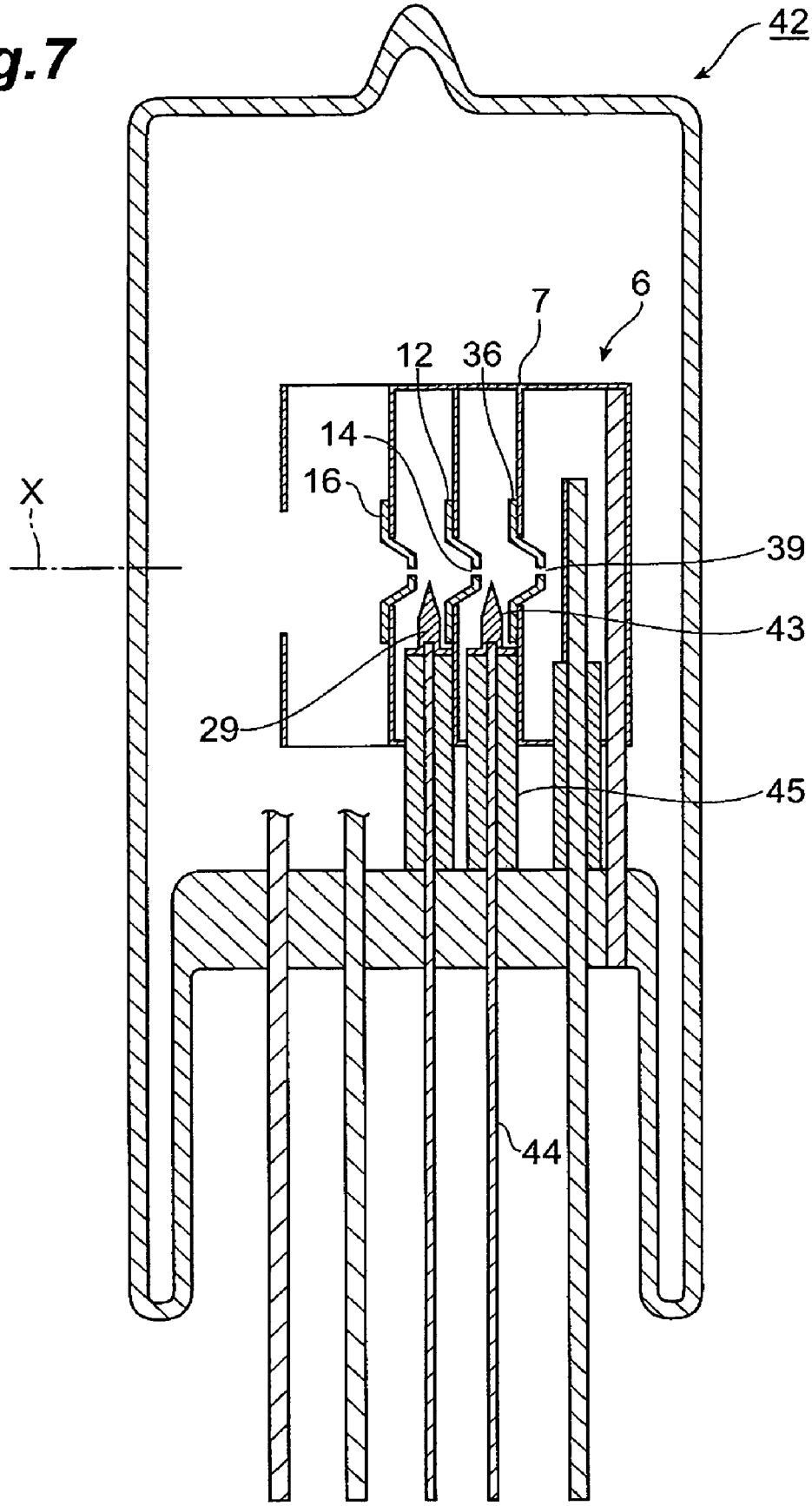
FIG. 7 is a sectional view showing a fourth embodiment of a gas discharge tube according to the present invention.
Figure 8:
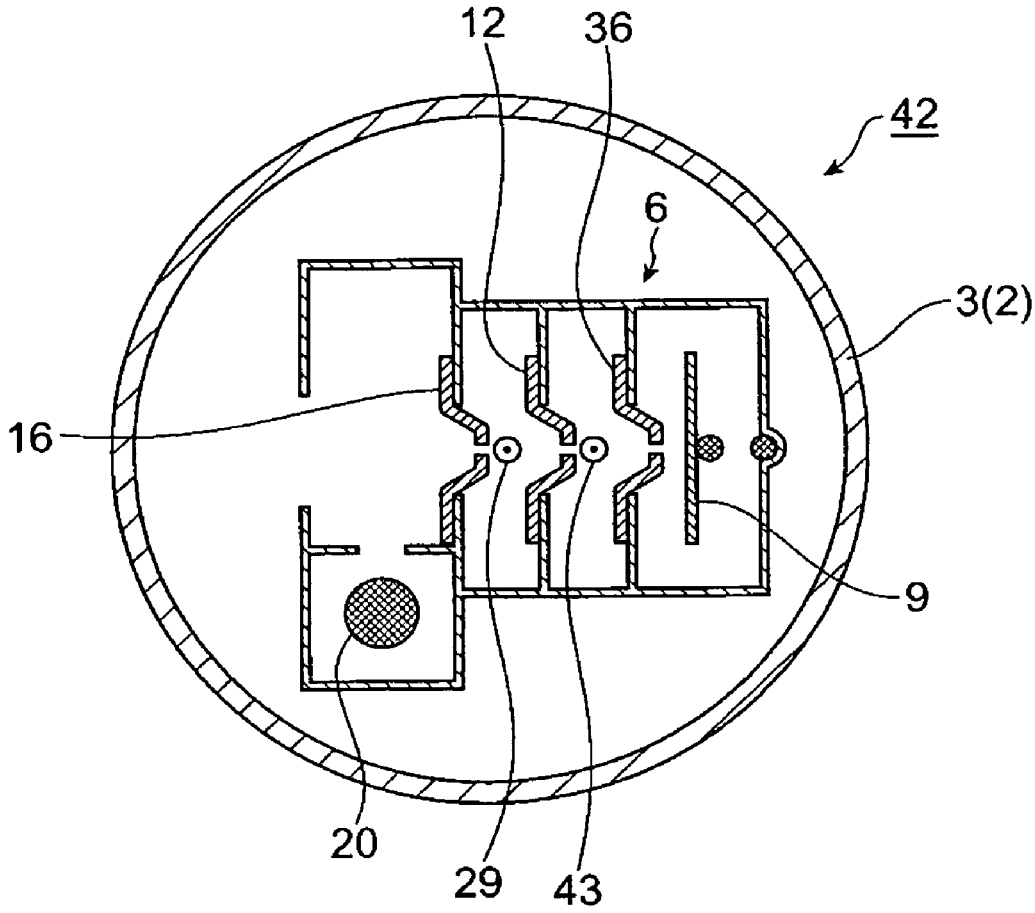
FIG. 8 is a transverse sectional view of the gas discharge tube shown in FIG. 7.

As shown in FIG. 7 and FIG. 8, a gas discharge tube 42 is a deuterium lamp of a side-on type. The gas discharge tube 42 is different from the second embodiment in that two discharge path-induction portions are provided, and identical or similar constitution portions thereof are designated with same reference numeral in the second embodiment and explanation thereof will be made.

A second discharge path-induction portion 43 is arranged between the second discharge path-limit portion 12 and the third discharge path-limit portion 36 inside the casing 7 of the gas discharge tube 42. The discharge path-induction portion 43 is welded and fixed to a distal end portion of a stem pin 44 which is provided upstanding on the stem 5 so as to extend in the Y direction of a tube axis. Then, the stem pin 44 is accommodated in a pipe 45 made of alumina or the like in order to maintain an electrically insulating property within the sealed container 2, and it can be supplied with a predetermined voltage from the outside.

Further, a distal end portion of the second discharge path-induction portion 43 is conical, and its tip end is provided at a position slightly deviated from a line connecting the second opening 14 and the third opening 39 so as not to block discharge. By sharpening the distal end of the second discharge path-induction portion 43 in this manner, a density of charged particles can be made higher at the tip end of the second discharge path-induction portion 43, so that the starting properties of a lamp can be made better.

By adopting such a second discharge path-induction portion 43 as described above, for example, a voltage of 350V is applied to the first discharge path-induction portion 29 and a voltage of 400V is applied to the second discharge path-induction portion 43 at a starting time. As a result, discharge is generated smoothly between the cathode portion 20 and the first discharge path-induction portion 29, and subsequently discharge is generated smoothly between the cathode portion 20 and the second discharge path-induction portion 43, these discharges serving as triggers so that discharge is generated smoothly between the cathode portion 20 and the anode portion 9. Then, once such a starting discharge is generated, arc discharge is maintained between the cathode portion 20 and the node portion 9 and arc balls are generated near by the first, second and third openings 19, 14 and 39 respectively for narrowing the discharge path. And, ultraviolet rays taken out from three arc balls pass through the light emitting window 4 to be emitted to the outside as light with an extremely high luminance.

FIFTH EMBODIMENT

Figure 9:
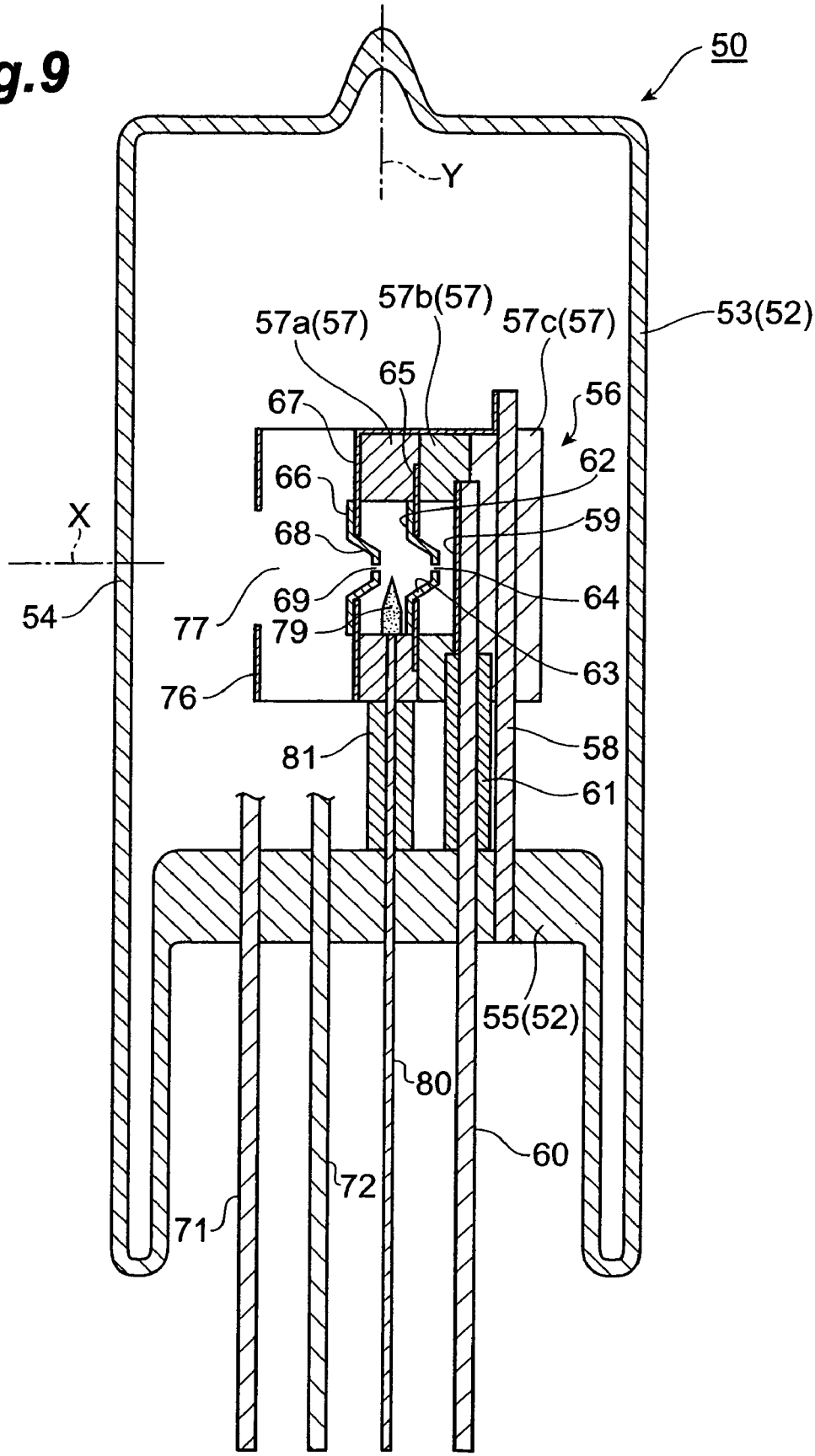
FIG. 9 is a sectional view showing a fifth embodiment of a gas discharge tube according to the present invention.
Figure 10:
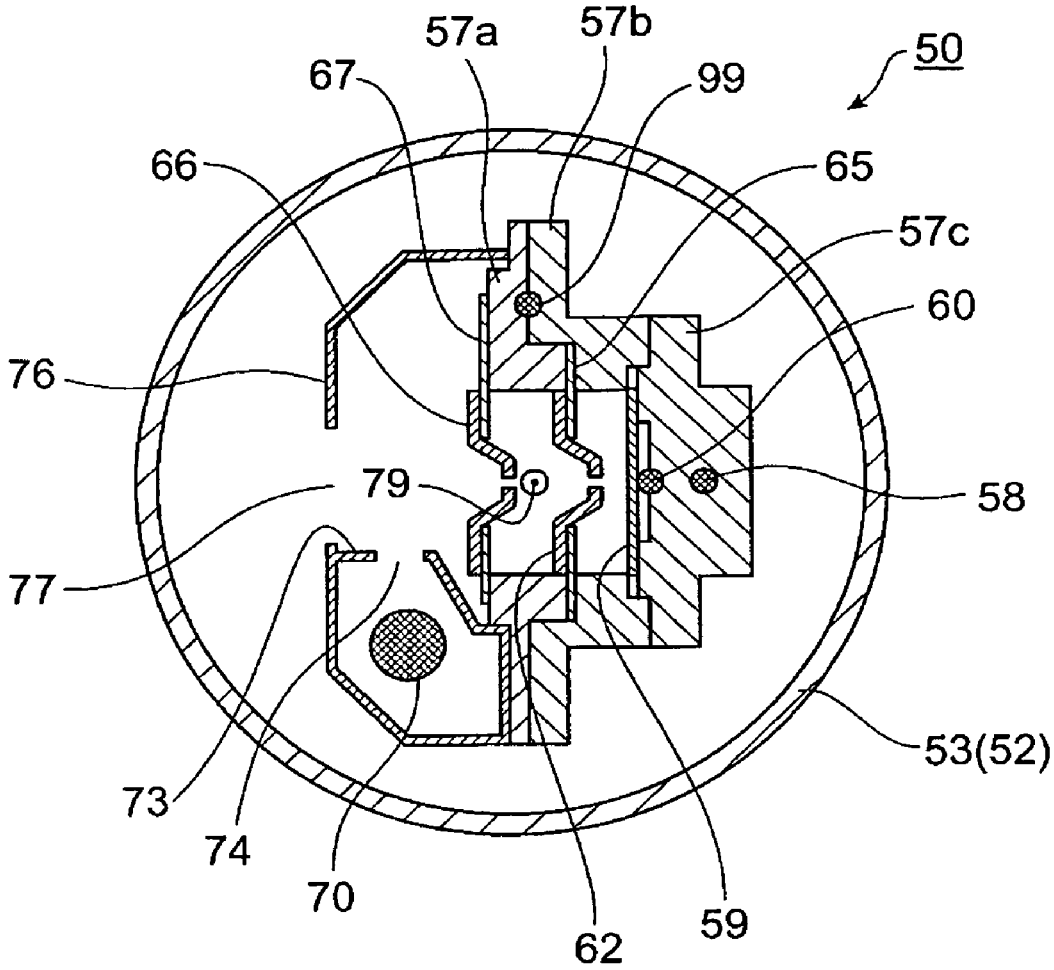
FIG. 10 is a transverse sectional view of the gas discharge tube shown in FIG. 9.

As shown in FIG. 9 and FIG. 10, a gas discharge tube 50 is a deuterium lamp of a side-on type, and the discharge tube 50 has a sealed container 52 made of glass in which deuterium gas is enclosed in an amount of about several hundreds Pa. This sealed container 52 comprises a cylindrical side tube 53 whose one end side is sealed and a stem 55 for sealing the other end side of the side tube 53, and one portion of the side tube 53 is utilized as a light emitting window 54. Then, a light emitting assembly 56 is accommodated inside the sealed container 52.

The light emitting assembly 56 has an electrically insulating casing 57 made of ceramics, and the casing 57 comprises a first electrically insulating portion 57*a* positioned at a front portion of the casing 57, a second electrically insulating portion 57*b* positioned at a middle portion of the casing 57 and a third electrically insulating portion 57*c* positioned at a rear portion of the casing 57, wherein ease of assembling is taken into account. The first electrically insulating body 57*a* and the second electrically insulating body 57*b* are annular, and they are provided in such a manner that they are coaxial to each other and their axial directions extend along an X direction of an optical axis line. A stem pin 58 extending in a Y direction of the tube axis is provided upstanding on the stem 55 to penetrate the third electrically insulating portion 57*c*. Further, a plate-like anode portion 59 is clamped by the second electrically insulating portion 57*b* and the third electrically insulating portion 57*c*, and the anode portion 59 is welded and fixed to a distal end portion of a stem pin 60 which is provided upstanding on the stem 55 to extend in a Y direction of the tube axis. Then, the stem pin 60 is accommodated in a pipe 61 made of alumina or the like in order to maintain an electrically insulating property within the sealed container 52.

Further, a second discharge path-limit portion 62 facing the anode portion 59 is accommodated within the casing 57, and the second discharge path-limit portion 62 is welded and fixed to an electrically conductive metal-made supporting plate 65. The supporting plate 65 is fixed to the casing 57 in such a way that it is interposed between the first electrically insulating portion 57*a* and the second electrically insulating portion 57*b*. In this manner, the second discharge path-limit portion 62 is positioned, being kept interposed between the first electrically insulating portion 57*a* and the second electrically insulating portion 5, via the metal-made supporting plate 65. Further, the anode 59 is positioned, being kept interposed between the second electrically insulating portion 57*b* and the third electrically insulating portion 57*c*. Accordingly, the second electrically insulating portion 57*b* functions as a spacer for positioning the anode portion 59 and the second discharge path-limit portion 62, so that positioning improvement for these members can be achieved. The second discharge path-limit portion 62 is made of electrically conductive metal (for example, molybdenum, tungsten, or alloy made of these material) and has a cup portion 63 for forming an arc ball, and this cup portion 63 is spread toward the light emitting window 54 so as to receive an arc ball produced by discharge to take out light with a high luminance efficiently. Further, a second opening 64 for narrowing the discharge path is provided at a bottom portion of the cup portion 63, and the second opening 64 comprises, for example, a small hole with a diameter of about 0.5 to 1 mm.

In addition, since the casing 57 is constituted with an electrically insulating ceramics, and a first discharge path-limit portion 66 and a second discharge path-limit portion 62 described later are electrically insulated from each other, the first discharge path-limit portion 66 and the second discharge path-limit portion 62 can be set to voltages different from each other in order to enhance a starting properties of the lamp. Therefore, in order to apply a predetermined voltage to the second discharge path-limit portion 62, the metal supporting plate 65 is electrically connected to a distal end portion of a stem pin(not shown) which is provided upstanding on the stem 55 to extend in a Y direction of a tube axis.

Furthermore, the second discharge path-limit portion 62 is accommodated in the casing 57 constituted by the first to third electrically insulating portions 57*a* to 57*c*, and it is shielded from a cathode portion 70 such that it can not been seen from the cathode portion 70. Thereby, thermions are prevented from traveling to the second discharge path-limit portion 62 through a route other than a route passing through a first opening 69 of the first discharge path-limit portion 66 and occurrence of an abnormal discharge is prevented.

Moreover, the first discharge path-limit portion 66 facing the second discharge path-limit portion 62 is fixed to the casing 57. The first discharge path-limit portion 66 is welded and fixed to an electrically conductive metal-made supporting plate 67 arranged at a front face of the first electrically insulating portion 57*a*, and the supporting plate 67 is welded and fixed to a distal end of the stem pin 58. The first discharge path-limit portion 66 is made of electrically conductive metal (for example, molybdenum, tungsten, or alloy made of these material) and has a cup portion 68 for forming an arc ball, and this cup portion 68 is spread toward the light emitting window 54 so as to receive an arc ball produced by discharge to take out light efficiently. Further, a first opening 69 for narrowing a discharge path is provided at a bottom portion of the cup portion 68, and the first opening 69 comprises a small hole with a diameter equal to or more than that of the second opening 64 (for example, about 0.5 to 1 mm). Then, the first opening 69 and the second opening 64 are aligned on an optical axis line X.

Furthermore, a cathode portion 70 is arranged at a position slightly deviated from an optical oath in the light emitting assembly 56 and the cathode portion 70 has a coil portion made of tungsten for generating thermions (refer to FIG. 10). Then, one end of the cathode portion 70 is welded and electrically connected to a stem pin 71 provided upstanding on the stem 55, and the other end of the cathode portion 70 is electrically connected to a stem pin 72 provided upstanding on the stem 55 via a lead portion welded to the stem pin 72.

In addition, a discharge rectifying plate 73 is provided at a position deviated from the optical path between the cathode portion 70 and the first discharge path-limit portion 66 and the discharge rectifying plate 73 is formed with an electron emitting opening 74 for allowing passing-through of thermions. Further, the casing 57 is fixed with an electrically conductive front cover 76 made of metal such as nickel or the like, and the front cover 76 is provided with a light passage opening 77 which is aligned to the first opening 69 and the second opening 64 on the optical axis line X. By accommodating the cathode portion 70 within the front cover 76 in this manner, sputter substance or evaporated substance generated from the cathode portion 70 is prevented from adhering to a light emitting window 54.

Here, in case where light with high luminance is to be created, it is insufficient to simply make the openings 64 and 69 for narrowing the discharge path smaller. The smaller the openings are made, the greater difficulty arises in causing discharge at a time of lamp starting. Therefore, in order to improve starting properties of a lamp, there is need to generate a remarkably large potential difference between the cathode portion 70 and the anode portion 59. As a result, it has been confirmed in an experiment that the service life of the lamp becomes short.

Therefore, a first discharge path-induction portion 79 is arranged between the first discharge path-limit portion 66 and the second discharge path-limit portion 62 inside the casing 57. The discharge path-induction portion 79 is welded and fixed to a distal end portion of a stem pin 80, which is provided upstanding on the stem 55 to extend in the Y direction of the tube axis. Then, the stem pin 80 is accommodated in a pipe 81 made of alumina or the like in order to maintain an electrically insulating property inside the sealed container 52 and can be supplied with a predetermined voltage from the outside.

Further, a distal end portion of the discharge path-induction portion 79 is conical, and its tip end is provided at a position slightly deviated from a line connecting the first opening 69 and the second opening 64 so as not to block discharge. When the distal end of the discharge path-induction portion 79 is sharpened in this manner, a density of charged particles can be enhanced at a tip end of the first discharge path-induction portion 79 so that the starting properties of the lamp can be made better.

By adopting such a discharge path-induction portion 79 as described above, there can be produced between the cathode portion 70 and the first opening 69 an active starting discharge making it possible to pass through the first opening 69 of the first discharge path-limit portion 66. For this reason, discharge at a starting time is facilitated to pass within the second opening 64. As a result, discharge between the cathode portion 70 and the anode portion 59 is started rapidly. With such a constitution, in order to achieve further enhancement of luminance, a further miniaturization of the openings 64 and 69, in terms of its area size, in the discharge path-limit portions can be accomplished easily while the starting properties is kept excellent without any increase in the voltage at the time of lamp starting so much. Incidentally, reference numeral 99 denotes a stem pin for supporting the light emitting assembly 59.

Next, an operation of the deuterium gas discharge tube 1 described above will be explained.

First, power of 10 W or so is supplied from the external power source to the cathode portion 70 via the stem pins 71 and 72 for about 20 seconds before discharge, so that a coil portion of the cathode portion 70 is preheated.

Thereafter, a voltage of about 160V is applied across the cathode portion 70 and the anode portion 59 from an external power source so that preparation for arc discharge is completed.

After the preparation has been completed, a trigger voltage of about 370V is applied from the external power source to the second discharge path restricting section 62 via a stem pin (not shown), and a trigger voltage of about 350V is similarly applied from an external power source to the discharge path-induction portion 29 via the stem pin 80. Thereby, discharge between the cathode portion 70 and the discharge path-induction portion 79 is generated, which serves as a trigger so that discharge is generated between the cathode portion 70 and the anode portion 59. Then, once such a starting discharge occurs, arc discharge is maintained between the cathode portion 70 and the anode portion 59, and arc balls are generated near the respective first and second openings 69 and 64, which have narrowed the discharge path. Then, ultraviolet rays taken out from two arc balls pass through the light emitting window 54 to be emitted to the outside as light with an extremely high luminance.

SIXTH EMBODIMENT

Figure 11:
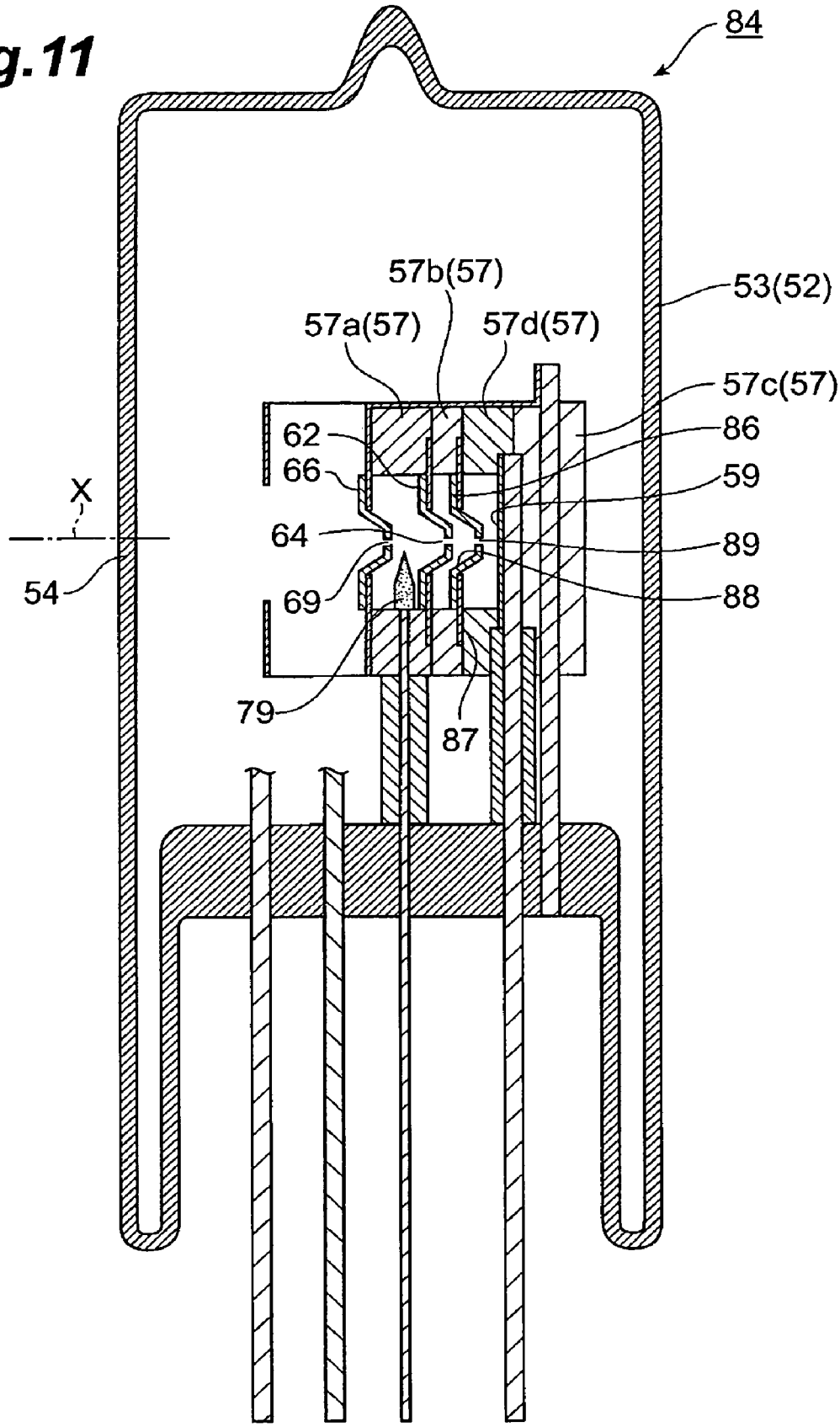
FIG. 11 is a sectional view showing a sixth embodiment of a gas discharge tube according to the present invention.
Figure 12:
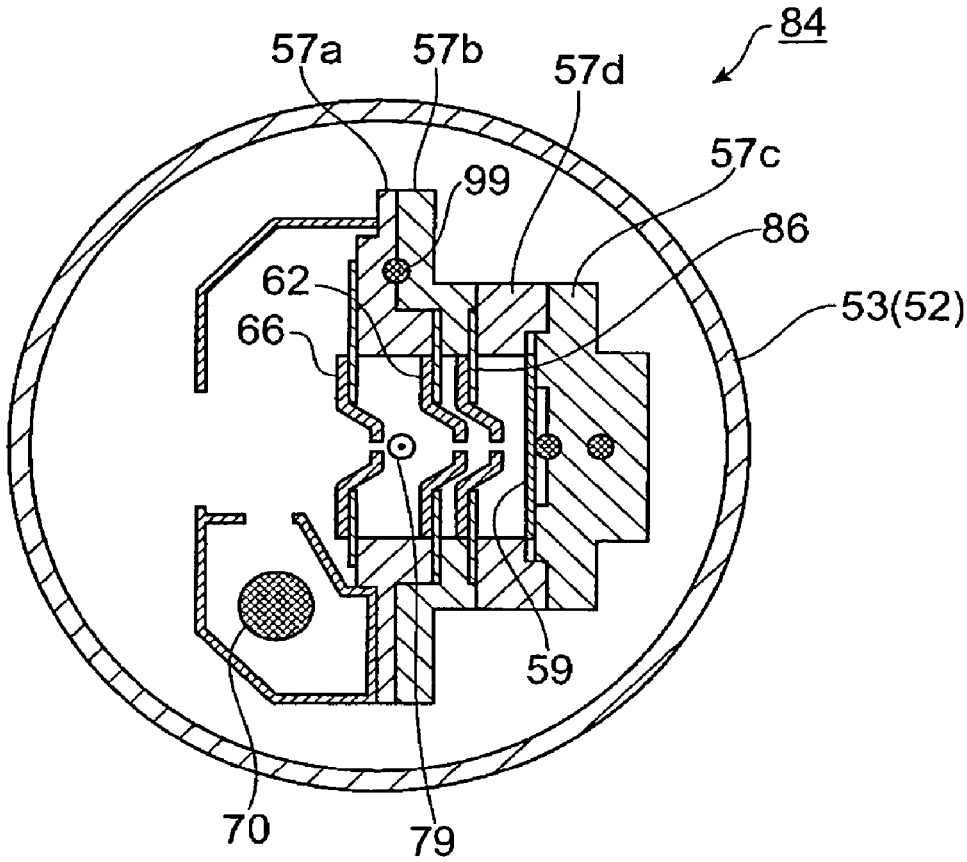
FIG. 12 is a transverse sectional view of the gas discharge tube shown in FIG. 11.

As shown in FIG. 11 and FIG. 12, a gas discharge tube 84 is a deuterium lamp of a side-on type. The gas discharge tube 84 is different from the fifth embodiment in that three discharge path-limit portions are provided, and identical or similar constitution elements therein are designated with same reference numerals and explanation thereof will be omitted.

A third discharge path-limit portion 86 is accommodated between the second discharge path-limit portion 62 and the anode portion 59 in the casing 57 of the discharge tube 84, and the third discharge path-limit portion 86 is welded and fixed to an electrically conductive metal-made supporting plate 87. The supporting plate 87 is fixed to the casing 57 being interposed between the second electrically insulating portion 57*b* and a fourth electrically insulating portion 57*d*. The fourth electrically insulating body 57*d* is annular, and it is provided coaxially with the first electrically insulating body 57*a* and the second electrically insulating body 57*b*. Thus, the third discharge path-limit portion 86 is positioned, being kept interposed between the second electrically insulating portion 57*b* and the fourth electrically insulating portion 57*d*, via the metal-made supporting plate 87. Further, the anode portion 59 is positioned, being kept interposed between the fourth electrically insulating portion 57*d* and the third electrically insulating portion 57*c*. Accordingly, the fourth electrically insulating portion 57*d* functions as a spacer for positioning the anode portion 59 and the third discharge path-limit portion 86, so that positioning accuracy for these members can be achieved. The third discharge path-limit portion 86 is made of electrically conductive metal (for example, molybdenum, tungsten, or alloy made of these material) and has a cup portion 88 for forming an arc ball, and this cup portion 88 is spread toward the light emitting window 54 so as to receive an arc ball produced by discharge to take out light efficiently.

Further, a third opening 89 for narrowing a discharge path is provided at a bottom portion of the cup portion 88, and the third opening 89 comprises a small hole with a diameter equal to or less than that of the second opening 64 (for example, about 0.5 to 1 mm). Then, the first opening 69, the second opening 64 and the third opening 89 are aligned on an optical axis line X. By utilizing the three discharge path-limit portions 62, 66 and 86 aligned in this manner, proper arc balls can be produced at the respective cup portions 63, 68 and 88, so that further increase in luminance can be achieved.

Then, as a result of such an arrangement that the second discharge path-limit portion 62 and the third discharge path-limit portion 86 come closer to each other, spreading of discharge can be suppressed at a location of the discharge path positioned between the second opening 64 and the third opening 89, so that a starting properties can be made better and luminance can be enhanced.

Further, since the casing 57 is constituted with electrically insulating ceramics, and a first discharge path-limit portion 66, a second discharge path-limit portion 62 and a third discharge path-limit portion 86 are electrically insulated from one another, the first discharge path-limit portion 66, the second discharge path-limit portion 62 and the third discharge path-limit portion 86 may be set to different voltages, so that the starting properties of the lamp can be enhanced.

Furthermore, the second and third discharge path-limit portions 62 and 86 are accommodated in the casing 57 constituted by with the first to fourth electrically insulating portions 57*a* to 57*d*, so that they are shielded from the cathode portion 70 such that they can not be seen from the cathode portion 70. Thereby, thermions are prevented from traveling to the second and third discharge path-limit portions 62 and 86 through a route other than a route passing through the first opening 69 of the first discharge path-limit portion 66, and occurrence of abnormal discharge is prevented.

SEVENTH EMBODIMENT

Figure 13:
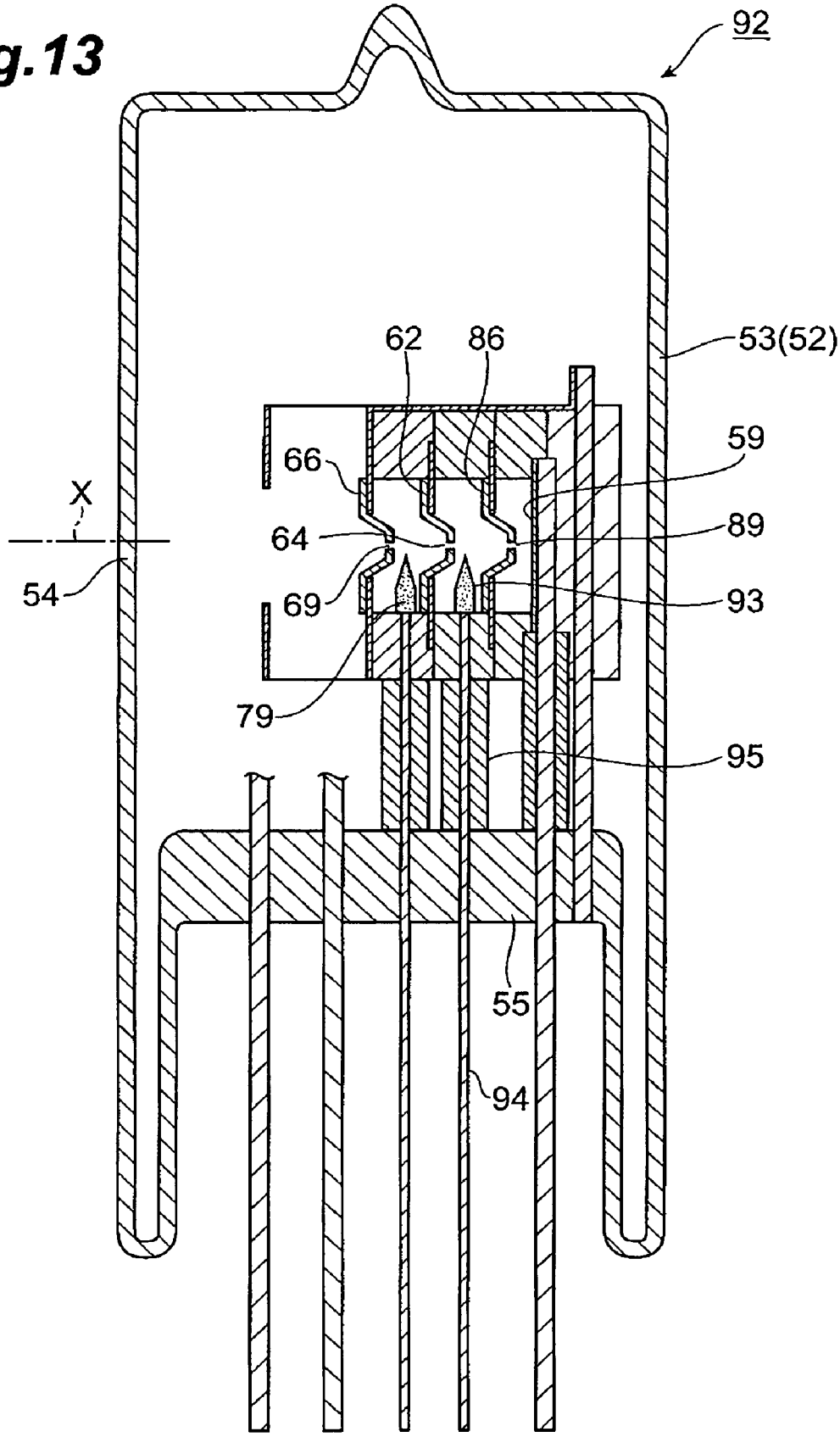
FIG. 13 is a sectional view showing a seventh embodiment of a gas discharge tube according to the present invention.
Figure 14:
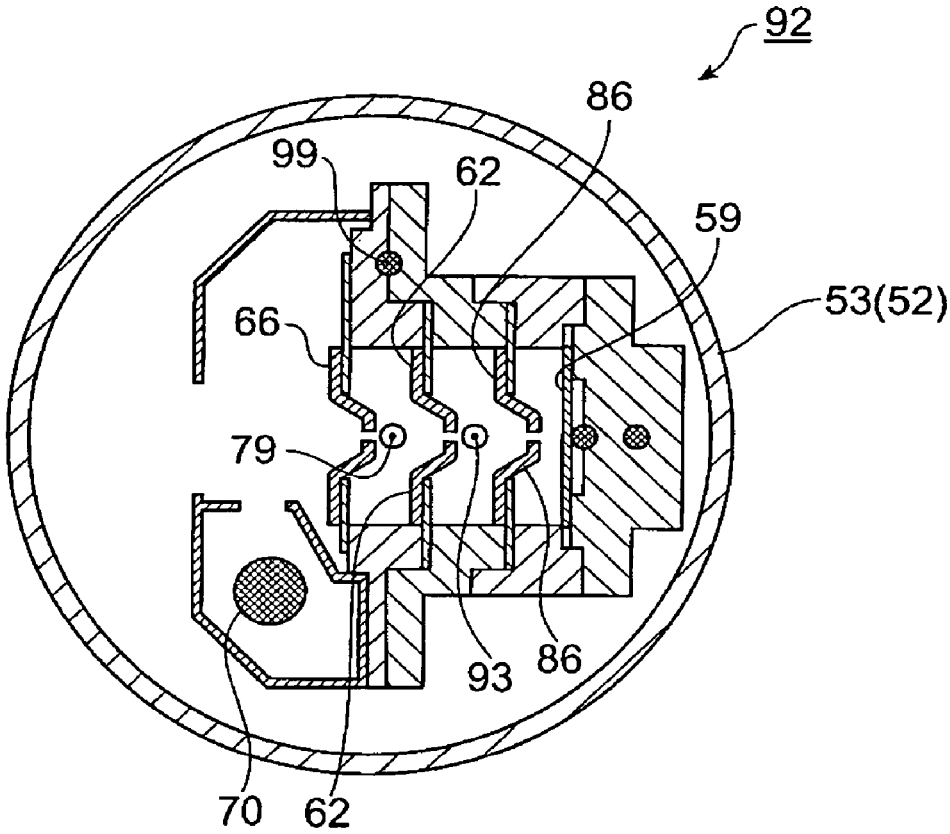
FIG. 14 is a transverse sectional view of the gas discharge tube shown in FIG. 13.

As shown in FIG. 13 and FIG. 14, a gas discharge tube 92 is a deuterium lamp of a side-on type. The gas discharge tube 92 is different from the sixth embodiment in that two discharge path-induction portions are provided, and identical or similar constitution elements therein are designated with same reference numerals and explanation thereof will be omitted.

A second discharge path-induction portion 93 is arranged between the second discharge path-limit portion 62 and the third discharge path-limit portion 86 in a casing 57 of the gas discharge tube 92. The discharge path-induction portion 93 is welded and fixed to a distal end portion of a stem pin 94, which is provided upstanding on the stem 55 so as to extend in the Y direction of a tube axis. Then, the stem pin 94 is accommodated in a pipe 95 made of alumina or the like in order to maintain an electrically insulating property within the sealed container 52, and it can be supplied with a predetermined voltage from the outside.

Further, a distal end portion of the second discharge path-induction portion 93 is conical, and its tip end is provided at a position slightly deviated from a line connecting the second opening 64 and the third opening 89 so as not to block discharge. By sharpening the distal end of the second discharge path-induction portion 93 in this manner, a density of charged particles can be made higher at the tip end of the second discharge path-induction portion 93, so that the starting properties of a lamp can be made better.

By adopting the second discharge path-induction portion 93 as described above, for example, a voltage of 350V is applied to the first discharge path-induction portion 79 and a voltage of 400V is applied to the second discharge path-induction portion 93 at a starting time. As a result, discharge is generated smoothly between the cathode portion 70 and the first discharge path-induction portion 79, and subsequently discharge is generated smoothly between the cathode portion 70 and the second discharge path-induction portion 93, these discharges serving as triggers so that discharge is generated smoothly between the cathode portion 70 and the anode portion 59. Then, once such a starting discharge is generated, arc discharge is maintained between the cathode portion 70 and the anode portion 59 and arc balls are generated near by the respective first, second and third openings 69, 64 and 89 for narrowing the discharge path. And, ultraviolet rays taken out from three arc balls pass through the light emitting window 54 to be emitted to the outside as light with an extremely high luminance.

Incidentally, in the gas discharge tubes 50 and 84 according to the fifth and sixth embodiments described above, such a constitution is employed that the first discharge path-induction portion 79 is provided, but a gas discharge tube can be constituted without providing such a discharge path-induction portion 79. Further, in the gas discharge tube 92 according to the seventh embodiment, such a constitution is employed that the first and second discharge path-induction portions 79 and 93 are provided, but a gas discharge tube can be constituted without providing such discharge path-induction portions 79 and 93.

From the above explanation of the present invention, it will be apparent that the present invention can be modified variously. It cannot be recognized that such a modification is deviated from the spirit and scope of the present invention, and all improvements obvious for those skilled in the art are included in the scope of claims described below.

INDUSTRIAL APPLICABILITY

According to the present invention, a gas discharge tube whose starting properties is excellent while realizing high luminance can be provided.

The invention claimed is:

1. A gas discharge tube for emitting a predetermined light from a light emitting window of a sealed container with a charged gas toward the outside by producing a discharge between a cathode portion and an anode portion enclosed in said container, said tube comprising:

a first discharge path-limit portion, arranged in a midway of a discharge path between said anode portion and said cathode portion, and provided with a first opening for narrowing said discharge path;

a second discharge path-limit portion, arranged in a midway of the discharge path between said first discharge path-limit portion and said anode portion, and provided with a second opening for narrowing said discharge path; and a first discharge path-induction portion, arranged between said first discharge path-limit portion and said second discharge path-limit portion, and electrically connected to an external power source.

2. A gas discharge tube according to claim 1, wherein said first discharge path-limit portion and said second discharge path-limit portion are electrically insulated from each other.

3. A gas discharge tube according to claim 1, wherein a distal end portion of said first discharge path-induction portion is conical.

4. A discharge tube according to claim 1, wherein the first and second openings of said first and second discharge path-limit portions are formed at bottom portions of cup portions spread toward said light emitting window.

5. A gas discharge tube according to claim 1, further comprising a third discharge path-limit portion, arranged in a midway of said discharge path between said second discharge path-limit portion and said anode portion, and provided with a third opening for narrowing said discharge path.

6. A gas discharge tube according to claim 5, wherein said second discharge path-limit portion and said third discharge path-limit portion are electrically insulated from each other.

7. A gas discharge tube according to claim 5, wherein the third opening of said third discharge path limit portion is formed at a bottom portion of a cup portion spread toward said light emitting window.

8. A gas discharge tube according to claim 5, comprising a second discharge path-induction portion, arranged between said second discharge path-limit portion and said third discharge path-limit portion, and electrically connected to an external power source.

9. A gas discharge tube according to claim 8, wherein a distal end portion of said second discharge path-induction portion is conical.

10. A gas discharge tube according to claim 8, wherein said second discharge path-induction portion is applied to a voltage higher than that applied to said first discharge path-induction portion.

11. A gas discharge tube for emitting a predetermined light from a light emitting window of a sealed container with a charged gas toward the outside by producing a discharge between a cathode portion and an anode portion enclosed in said container, said tube comprising:

a first discharge path-limit portion, arranged in a midway of a discharge path between said anode portion and said cathode portion, and provided with a first opening for narrowing said discharge path; and a second discharge path-limit portion, arranged in a midway of the discharge path between said first discharge path-limit portion and said anode portion, and provided with a second opening for narrowing said discharge path, and the first and second openings aligned along an optical axis;

an electrically insulating casing that extends along the optical axis between a back side of said second discharge path-limit portion and a back side of said first discharge path-limit portion, and that encloses and shields said second discharge path-limit portion with respect to said cathode portion;

a front cover, disposed at a front side of said first discharge path-limit portion, that has a light passage opening aligned along the optical axis, and that accommodates said cathode portion inside; and a discharge rectifying plate, provided inside the front cover, that has an electron emission opening deviated from the optical axis for allowing passing through of thermions emitted by said cathode portion;

wherein said first discharge path-limit portion and said second discharge path-limit portion are electrically insulated from each other; and wherein said second discharge path-limit portion is exposed to said cathode portion only through said first opening of said first discharge path-limit portion.

12. A gas discharge tube according to claim 11, wherein an annular spacer of insulating material for positioning the second discharge path-limit portion and the anode portion is provided between said second discharge path-limit portion and said anode portion.

13. A gas discharge tube according to claim 11, further comprising a third discharge path-limit portion, arranged in a midway of said discharge path between said second discharge path-limit portion and said anode portions, and provided with a third opening for narrowing said discharge path, said first, second and third discharge path-limit portions being electrically insulated, respectively.

14. A gas discharge tube according to claim 13, wherein said third discharge path-limit portion is enclosed in said casing so as to be exposed to said cathode portion only through said first and second openings of said first and second discharge path-limit portions.

15. A gas discharge tube according to claim 14, wherein an annular spacer of insulating material for positioning the third discharge path-limit portion and the anode portion is provided between said third discharge path-limit portion and said anode portion.

16. A gas discharge tube according to claim 11, wherein said anode portion is enclosed in said casing so as to be exposed to said cathode portion only through said first and second openings of said first and second discharge path-limit portions.

* * * * *